United States Patent [19]

Dare et al.

[11] 4,215,749

[45] Aug. 5, 1980

[54] GATE VALVE FOR SHEARING WORKOVER LINES TO PERMIT SHUTTING IN OF A WELL

[75] Inventors: Roy R. Dare; Jeff L. Merten, both of Houston, Tex.

[73] Assignee: ACF Industries, Incorporated, New York, N.Y.

[21] Appl. No.: 9,018

[22] Filed: Feb. 5, 1979

[51] Int. Cl.[2] ..... E21B 29/00

[52] U.S. Cl. ..... 166/361; 166/55; 251/1 A; 137/68 A

[58] Field of Search ..... 166/55, 55.1, 363, 364, 166/75, 75 A, 361; 251/1 A, 1 R; 137/68 A

[56] References Cited

U.S. PATENT DOCUMENTS

| | | | |
|---|---|---|---|
| 3,716,068 | 2/1973 | Addison | 255/1 A X |
| 3,766,978 | 10/1973 | Orund et al. | 166/55 |
| 3,870,098 | 3/1975 | Houston | 166/363 X |
| 3,946,806 | 3/1976 | Meynier | 166/55 |
| 4,130,161 | 12/1978 | Jones | 166/363 X |
| 4,132,265 | 1/1979 | Williams, Jr. | 166/55 X |

*Primary Examiner*—James A. Leppink
*Assistant Examiner*—Richard E. Favreau
*Attorney, Agent, or Firm*—Eugene N. Riddle

[57] ABSTRACT

A gate valve which is mounted on a wellhead assembly and which may be closed to shear off workover lines, macaroni tubing and other suspension members so as to quickly shut in a well under emergency conditions. The gate has a flow port which aligns with the flow passage of the valve when the gate is open. A cutting edge of the port cooperates with a corner area of the downstream valve seat to shear the suspension member when the gate is forcefully closed by a hydraulic actuator mechanism. An undercut open space is presented immediately below the cutting edge to accommodate the sheared suspension member without jamming the gate or otherwise hampering its closure function.

10 Claims, 6 Drawing Figures

GATE VALVE FOR SHEARING WORKOVER LINES TO PERMIT SHUTTING IN OF A WELL

BACKGROUND OF THE INVENTION

This invention relates generally to gate valves and deals more particularly with a gate valve which is capable of being closed in a manner to cut tubing and other suspension members that extend downwardly into a well.

In testing and workover operations performed on oil and gas wells, it is common for wire lines and power cables to be suspended through the wellhead and into the well to support various types of tools and instruments and to supply electrical power to a downhole equipment. It is also common to extend relatively small diameter steel pipe known as "macaroni" tubing into the well to treat the production zones and perform other services. When an emergency arises requiring that the well be immediately shut in, there is usually insufficient time to withdraw the macaroni tubing or the various lines and cables. Consequently, in the event of such an emergency, these suspension members must be cut off in order to quickly shut in the well.

Although the macaroni tubing is normally one inch in diameter or less, it is sometimes considerably larger such as two inches in diameter with a wall thickness of about $\frac{1}{8}$ inch. Manifestly, a considerable force is required to shear off pipe of this size. In addition, it is usually necessary to contend with subsea conditions because the emergency situations that require shutting in of the well occur most frequently with subsea wells.

SUMMARY OF THE INVENTION

The present invention is directed to a gate valve which may be forcefully closed to shut in a well and to shear off any tubing, cables, wires, or other suspension members that are suspended in the flowline of the well. In accordance with the invention, a slab type gate valve is mounted on top of a wellhead assembly. The gate has a flow port formed therethrough which aligns with the flow passage of the valve when the gate is open and which is large enough to readily accommodate the suspension members that may be suspended in the well for purposes of testing and performing workover operations and other services on the well. The flow port of the gate has a specially formed cutting edge adjacent the upper surface of the gate which is sharp enough to completely shear off these suspension members when the gate is forcefully closed, as by means of a hydraulic actuator or the like. A corner portion of the upper or downstream valve seat cooperates with the cutting edge to effect shearing of the suspension member when the gate is closed to shut in the well.

An important feature of the invention is the provision of a double undercut area beneath the cutting edge of the gate. The configuration of the undercut portion allows the sheared suspension member to fall freely into the well without jamming or otherwise interfering with the closure function of the gate. At the same time, the undercut portion is shaped and dimensioned in a manner to avoid unduly weakening the cutting edge.

Another important inventive feature is the contour of the cutting edge which presents converging sides that meet at an obtuse angle to form a central notch area of the cutting edge. The suspension members are centered in the notch such that the shearing force is directed radially of the valve seat, thereby maximizing the cutting action and minimizing the force required to close the gate and the possibility of the suspension members jamming in the gate.

As a still further advantage of the invention, the cutting edge of the gate is formed as to be capable of readily shearing the largest and thickest "macaroni" type tubing employed in well treatment and workover operations, as well as smaller suspension members such as wires and cables.

Yet another object of the invention is to provide a gate valve of the character described which is adapted to be used in a subsea environment.

DESCRIPTION OF THE DRAWINGS

In the accompanying drawings which form a part of the specification and are to be read in conjunction therewith.

DETAILED DESCRIPTION OF THE INVENTION

Figure 1:
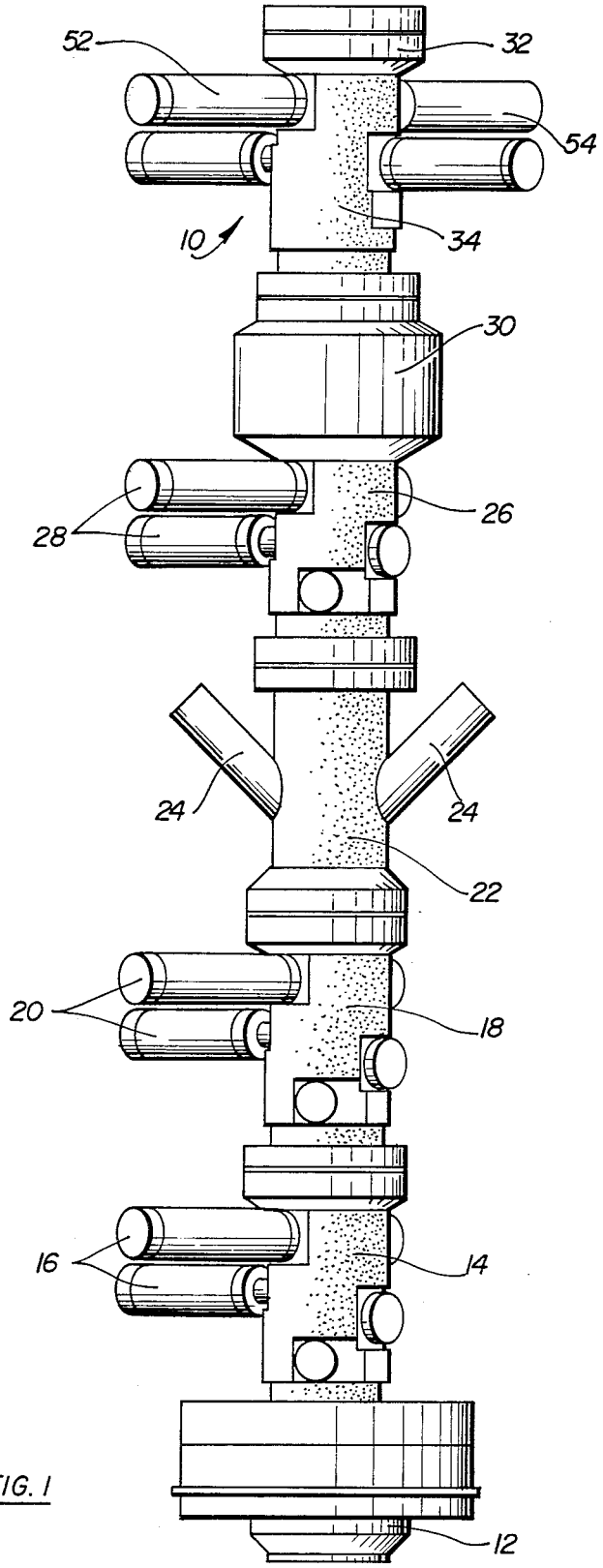
FIG. 1 is an elevational view of a subsea wellhead and Christmas tree assembly equipped with a gate valve constructed according to a preferred embodiment of the present invention.

FIG. 1 illustrates a subsea wellhead and Christmas tree assembly which includes a gate valve 10 constructed according to a preferred embodiment of the present invention. The wellhead assembly includes a casing head 12 from which one or more strings of well casing (not shown) extend downwardly into the well bore. A lower master valve 14 is mounted on top of casing head 12. For purposes of illustration, the wellhead assembly is for a double completion well; accordingly, the lower master valve 14 has a valve for each of the two strings of production tubing (not shown), along with a valve for the generally annular space between the tubing and casing. Each valve included in the master valve 14 is preferably a conventional gate valve controlled by a hydraulic valve actuator 16.

An upper master valve 18 likewise includes a gate valve for each tubing string, another gate valve for the annulus, and an actuator 20 for each gate valve. A diverter spool 22 mounted on top of the upper master valve 18 includes a pair of outlets 24 which connect with the production tubing and to which flowlines (not shown) may be attached. A swab valve 26 is mounted on top of diverter spool 22 and includes three gate valves and an actuator 28 for each gate valve. A hydraulic connector 30 is mounted on top of swab valve 26 and receives the gate valve 10 of the present invention. A riser assembly 32 extends upwardly from gate valve 10 to the surface and is equipped at its upper end with a surface valve (not shown).

Figure 2:
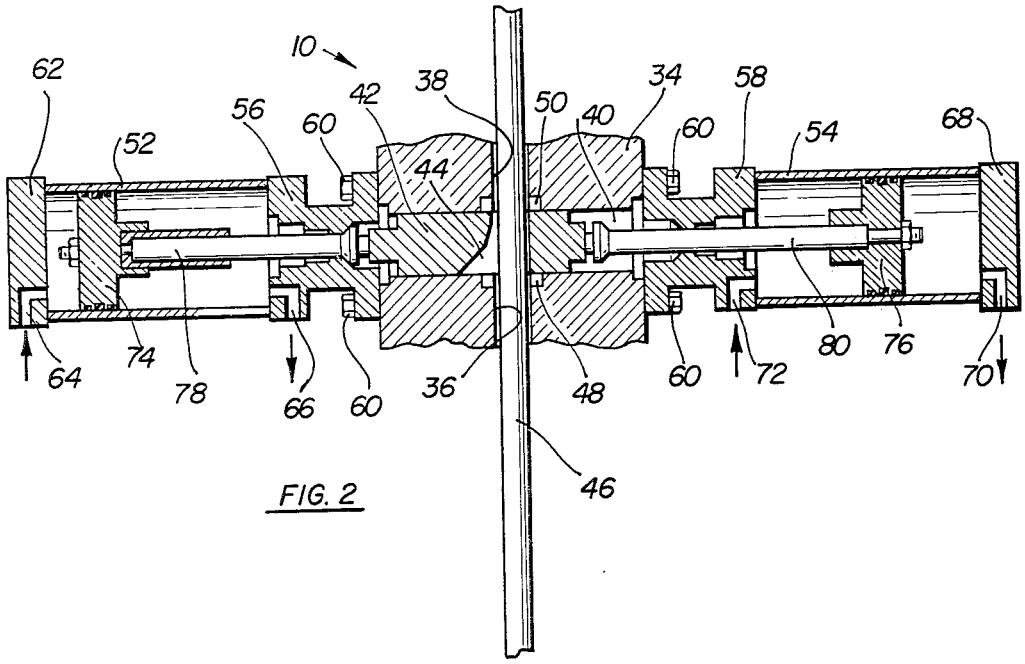
FIG. 2 is an enlarged sectional view taken on a vertical plane and showing a portion of the gate valve and one of the gates, with the gate in its open position, and with a string of "macaroni" tubing suspended through the valve.
Figure 3:
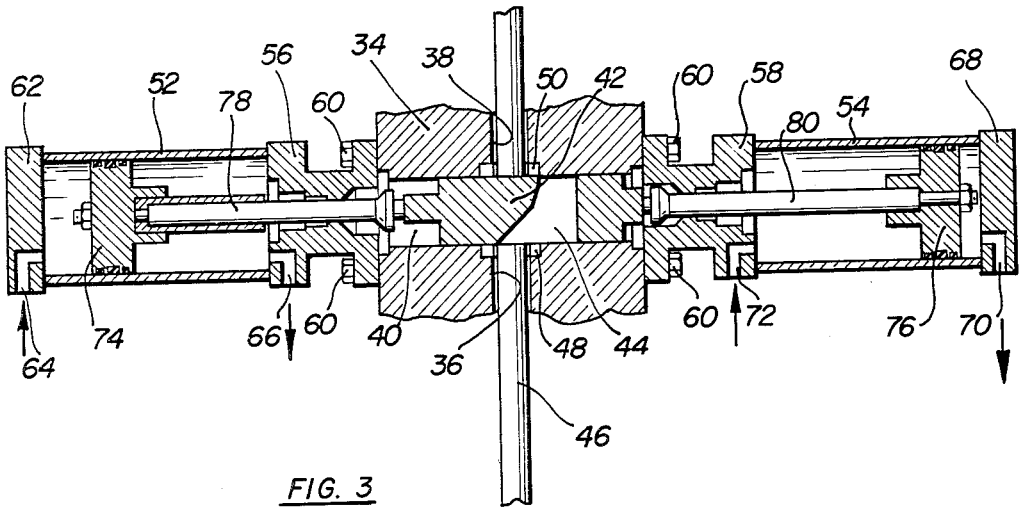
FIG. 3 is a sectional view similar to FIG. 2 but showing the gate moved to its closed position to shut in the well and cut off the tubing string.

Referring now more particularly to FIGS. 2 and 3, gate valve 10 includes a valve body 34 which is provided with a pair of vertical passages and a gate for each passage, since the valve is for a dual completion well. Each vertical flow passage includes an inlet passage 36 at its lower portion and an outlet passage 38 at its upper portion. The valve body 34 also includes, for each passage, a central valve chamber 40 located between the inlet passage 36 and the outlet passage 38 in communication therewith.

Each valve chamber 40 is oriented horizontally and each chamber receives a slab type gate 42 which is mounted in the valve chamber for horizontal movement between an open position and a closed position relative to the flow passage of the valve. Each gate 42 has a flow port 44 which aligns with the corresponding passages 36 and 38 when the gate is in the open position shown in FIG. 2, and which is out of alignment with the flow passage when the gate is in the closed position shown in FIG. 3. Flow passages 36 and 38 and port 44 are large enough to receive "macaroni" tubing such as the relatively large string of steel tubing 46 which extends downwardly through the Christmas tree and wellhead assembly into the well in order to facilitate the performance of workover operations such as fracturing, well testing, and the like. Passages 36 and 38 and port 44 are also large enough to accommodate the various types of workover lines and power cables (not shown) which are sometimes suspended in the well to support tools and instruments and to supply electrical power to the downhole equipment.

Each lower or upstream flow passage 36 is provided with an annular groove adjacent to valve chamber 40 which receives an annular valve seat 48. Similarly, each upper or downstream flow passage 38 has an annular groove formed about it at a location adjacent the valve chamber, and an upper or downstream valve seat 50 is mounted in each upper groove at a location above gate 42. Valve seats 48 and 50 cooperate with gate 42 to block the flow passage of the valve when the gate is in its closed position.

Each gate 42 is moved between the open and closed positions by a hydraulic actuator mechanism which includes a pair of cylinders 52 and 54 having respective bases 56 and 58 which are mounted to opposite sides of the valve body 34, as by means of bolts 60. Each cylinder 52 has an end cap 62 which covers its outer end and which is provided with a fluid passage 64 communicating with the outer end portion of the cylinder. Another fluid passage 66 is formed through base 56 in communication with the inner end portion of cylinder 52. Each cylinder 54 likewise has an end cap 68 having a flow passage 70 communicating with the outer end portion of the cylinder. A flow passage 72 formed through base 58 communicates with the inner end portion of cylinder 54.

Cylinders 52 and 54 have respective pistons 74 and 76 which are connected with piston rods 78 and 80, respectively. Piston rods 78 and 80 extend through the respective bases 56 and 58 and pivotally connect at their inner ends with opposite ends of gate 42.

Closing of gate 42 is effected by supplying hydraulic fluid to passages 64 and 72 and exhausting fluid through passages 66 and 70, as indicated by the directional arrows in FIG. 2. The fluid pressure forces pistons 74 and 76 to the right from the position of FIG. 2 to the position of FIG. 3, thereby forcefully closing gate 42. The gate may be opened by supplying pressurized hydraulic fluid to passages 66 and 70 while exhausting fluid through passages 64 and 72, thereby moving the gate to the left from the closed position of FIG. 3 to the open position of FIG. 2. The flow of hydraulic fluid to and from cylinders 52 and 54 is controlled from the surface in a well known manner. It is to be understood that gate 42 may be controlled by a single hydraulic actuator or by any other suitable type of actuator capable of closing the gate with sufficient force to shear off tubing 46 and other suspension members as will be more fully explained.

Figure 4:
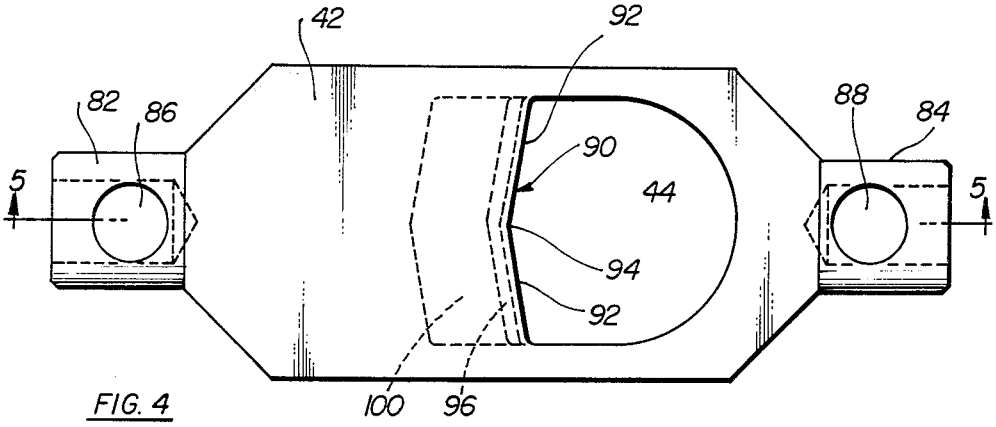
FIG. 4 is a top plan view of one of the gates which is employed in the gate valve.
Figure 5:
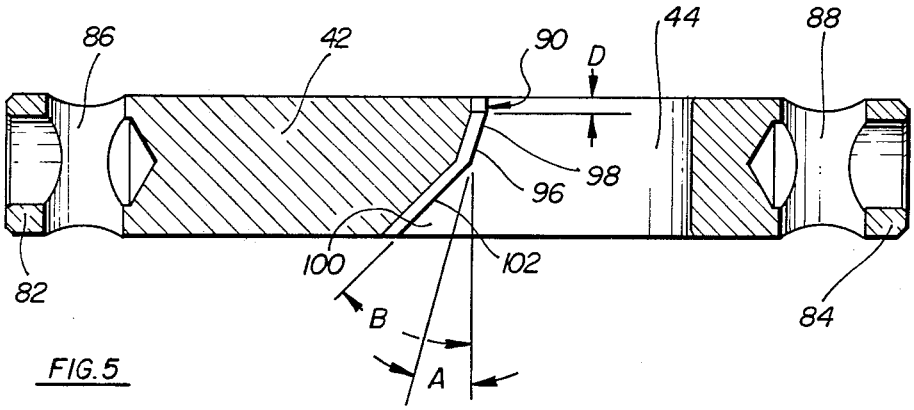
FIG. 5 is a sectional view of the gate taken generally along the line 5—5 of FIG. 4 in the direction of the arrows.

FIGS. 4 and 5 best illustrate the configuration of gate 42 and its flow port 44. Since each gate 42 is constructed in the same manner, only one gate will be described. Opposite ends of each gate 42 are provided with lugs 82 and 84 which are bored to receive the ends of the respective piston rods 78 and 80. Vertical openings 86 and 88 are formed through the respective lugs 82 and 84 to receive pivot couplings (not shown) which pivotally connect gate 42 with the piston rods 78 and 80.

The right side of port 44 (as viewed in FIG. 4) is generally rounded, while the left side of port 44 is in the form of a cutting edge which is generally designated by reference numeral 90. As shown in FIG. 5, cutting edge 90 is located adjacent to the flat upper surface of gate 42. For the optimum combination of cutting action and strength of cutting edge 90, it has been found that the dimension "D", which represents the thickness of the cutting edge, should preferably be in the range of $\frac{1}{8}$ inch to $\frac{5}{8}$ inch with approximately $\frac{1}{4}$ inch being preferred in most cases. Cutting edge 90 includes a pair of converging sides 92 which meet at the center of the cutting edge 90 at an obtuse angle to form a notch 94 in the center of the cutting edge. Preferably, the angle at which sides 92 meet is in the range of between 150° to 170°, with approximately 160° being preferred in most applications of the gate valve.

With reference to FIG. 5 in particular, gate 42 has an upper undercut portion 96 formed adjacent to flow port 44 and immediately underlying cutting edge 90. Undercut portion 96 has an inclined surface 98 on gate 42 which is inclined from vertical at an angle "A" which is preferably in the range of 10° to 25°, with approximately 17° to 18° being preferred in most cases. A second or low undercut area 100 is located immediately below undercut portion 96 on the lower portion of the gate. The lower undercut 100 has an inclined surface 102 on the gate which is inclined from vertical at an angle "B". Angle "B" is substantially greater than angle "A" and is preferably between 30° and 60°, with approximately 45° being preferred for most applications of the gate valve.

In use, valve body 34 is carried on the lower end of the riser assembly 32 and is coupled with the top of hydraulic connector 30. Each gate 42 is normally in its open position so that suspension members such as tubing 46 may be extended through each passage of the valve, the Christmas tree, the wellhead assembly and into the well for the performance of various workover and well treatment operations and other services. In the event of an emergency requiring that the well be immediately shut in, each gate 42 may be forcefully closed by the hydraulic actuator mechanism to shut in the well and shear tubing 46 and any other suspension members extending into the well.

Figure 6:
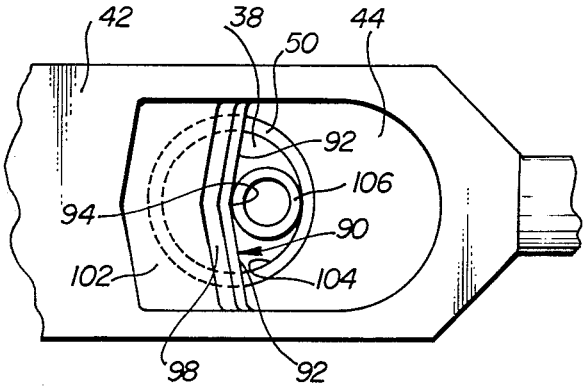
FIG. 6 is a fragmentary bottom plan view showing the gate immediately before it is closed to effect shearing of the tubing and shutting in of the well.

When gate 42 is forcefully closed, cutting edge 90 cooperates with an adjacent corner 104 (see FIG. 6) of the upper or downstream valve seat 50 to shear off the large diameter tubing 46 or the smaller diameter "macaroni" type tubing 106 shown in FIG. 6. If tubing 106 is initially off center in the flow passage of the valve, one of the angled converging sides 92 of the cutting edge contacts the tubing, and by camming action, moves the tubing into the central notch 94 of the cutting edge. Tubing 106 is thus properly centered in notch 94 which moves radially toward seat 50 as the valve is closed. Consequently, a maximum cutting action is achieved and the actuator force required to effect closing of the valve is minimized. At the same time, centering of the suspension member significantly reduces the possibility of it catching or jamming in gate 42 or otherwise interfering with the closure function of the gate. It has been found that the range of angles indicated previously for the convergence of sides 92 effectively centers the suspension member while avoiding an unduly sharp angle which could reduce the effectiveness of the cutting edge in shearing off the suspension member. Accordingly, the indicated range of angles is preferred although it is contemplated that other angles may be used effectively in some situations.

The location of cutting edge 90 adjacent the upper surface of gate 42 and the provision of undercut portions 96 and 100 permits the sheared suspension member to freely fall downwardly through port 44 and through the Christmas tree valves into the well without jamming gate 42. It has been found that with angle "A" in the range indicated previously, sufficient space is provided below edge 90 to permit the sheared tubing to readily drop below the valve. At the same time, the angle is small enough to provide sufficient material near edge 90 to avoid unduly weakening the cutting edge. For the same reason, the dimension "D" is preferably within the indicated range so that the cutting edge 90 is sharp enough to effectively shear the suspension member while being strong enough to withstand the forces applied to it during the shearing operation. The second or lower undercut portion 100 is also important in permitting the sheared tubing to drop through the valve, and the angle of surface 102 is preferably within the indicated range to avoid unduly weakening the portion of gate 42 to which the majority of the forces are applied during the cutting operation. Again, it is contemplated that dimension "D" and angles "A" and "B" may be outside the indicated ranges in some circumstances.

Although the primary use of gate valve 10 is in connection with subsea wells, the valve also finds utility in connection with wells which are drilled on land. Also, it is to be understood that gate 42 may be employed to shear off various types of suspension members such as tubing, cables, wires and power lines of the type that are extended into wells during testing and workover operations. It has been found that a valve constructed in accordance with the illustrated embodiment of the invention is capable of effectively shearing steel "macaroni" tubing having a diameter of approximately 2 inches and a wall thickness of approximately ⅛ inch, as well as wires and cable having a lesser size. Although a valve employing a pair of gates is shown, it is to be understood that the valve may include only one gate or any other number of gates.

Having thus described the invention, we claim:

1. A gate valve for closing in a well and for cutting an elongate suspension member extending into the well through a wellhead assembly, said gate valve comprising:

a valve body adapted to be mounted on the wellhead assembly, said valve body presenting a valve chamber and a flow passage which communicates with the well and is of sufficient size to receive the suspension member;

a gate mounted in said valve chamber for substantially horizontal movement between an open position and a closed position relative to said flow passage;

a flow port formed through said gate and sufficient in size to receive the suspension member, said port being aligned with said flow passage when the gate is in the open position and being out of alignment with the flow passage when the gate is in the closed position;

a pair of annular valve seats mounted in said valve body about said flow passage at locations adjacent the valve chamber, said seats cooperating with said gate to close said flow passage when the gate is in the closed position;

actuator means for forcefully moving said gate from the open to the closed position; and a cutting edge of said flow port located adjacent the upper surface of the gate, said cutting edge having a thickness of between approximately ⅛ inch and ⅜ inch and being adapted to cooperate with one of said valve seats to effect shearing of the suspension member upon movement of said gate to the closed position to close said flow passage, said one valve seat being an upper valve seat located above the gate and presenting a corner area for cooperation with said cutting edge to effect shearing of the suspension member.

2. A gate valve as set forth in claim 1, wherein said cutting edge of the flow port includes a pair of converging side portions which meet at an obtuse angle to form a central notch portion of the cutting edge, said notch portion moving radially toward said one valve seat as said gate moves to the closed position.

3. A gate valve as set forth in claim 1, including an undercut portion of said gate immediately underlying said cutting edge to provide space permitting the suspension member to drop below the gate after the suspension member has been sheared.

4. A gate valve as set forth in claim 3, wherein said undercut portion has a surface on the gate which is inclined from vertical at an angle of between approximately 10° to 25°.

5. A gate valve as set forth in claim 4, including a second undercut portion of said gate immediately underlying the first mentioned undercut portion, said second undercut portion having a surface on the gate which is inclined from vertical at an angle of between approximately 30° to 60°.

6. A gate valve for closing in a well and for cutting an elongate suspension member extending into the well through a wellhead assembly, said gate valve comprising:

a valve body adapted to be mounted on the wellhead assembly, said valve body presenting a valve chamber and a flow passage which communicates with the well and is of sufficient size to receive the suspension member;

a gate mounted in said valve chamber for generally horizontal movement between an open position and a closed position relative to said flow passage;

a flow port formed through said gate and sufficient in size to receive the suspension member, said port being aligned with said flow passage when the gate is in the open position and being out of alignment with the flow passage when the gate is in the closed position;

upper and lower annular valve seats mounted in said valve body about said flow passage at locations adjacent the valve chamber, said seats cooperating with said gate to close said flow passage when the gate is in the closed position;

actuator means for forcefully moving said gate from the open to the closed position;

a curved edge portion of said flow part generally conforming to the flow passage in size and shape; and a cutting edge of said flow part opposing said curved edge portion on an opposite side of the flow port, said cutting edge being adapted to cooperate with the upper valve seat to effect shearing of the suspension member upon movement of said gate to the closed position thereof, said gate having an undercut open space immediately below said cutting edge to accommodate the sheared suspension member as same is falling below the gate.

7. A gate valve as set forth in claim 6, including a second undercut portion of said gate underlying said undercut open space thereof, said second undercut portion being undercut more severely than said undercut open space.

8. In a subsea wellhead assembly having a wellhead with production tubing extending downwardly therefrom into a subsea well, a master valve surmounting said wellhead for controlling the flow of well fluids through the tubing, a side outlet located above the master valve in communication with the tubing to direct the well fluids generally to the side of the wellhead assembly, means providing a generally vertical passage extending above the side outlet to form an upward continuation of the tubing, a swab valve for controlling fluid flow through said vertical passage, and a riser assembly communicating at its lower end with said vertical passage and extending to the water surface to permit a suspension member to be extended generally vertically into the well through said riser assembly, swab valve, vertical passage and tubing, the combination therewith of:

a gate valve body presenting a valve chamber and a flow passage, said gate valve body being mounted to the wellhead assembly between the swab valve and riser assembly with said flow passage of the valve body forming a portion of said vertical passage;

a gate mounted in said valve chamber for generally horizontal movement between an open position permitting fluid flow through said flow passage and a closed position blocking fluid flow through said flow passage;

an annular valve seat mounted in the valve body adjacently above said gate and cooperating with the gate in the closed position thereof to block said flow passage;

actuator means for forcefully moving said gate from the open position to the closed position thereof; and a cutting edge of said gate cooperating with said valve seat to effect shearing of the suspension member upon forceful movement of said gate from the open position to the closed position, said gate having an undercut open space below said cutting edge to permit passage of the sheared suspension member downwardly through the vertical passage and swab and master valves into the well.

9. The invention set forth in claim 8, including a port through said gate at a location to be in alignment with said flow passage in the open position of the gate and out of alignment with said flow passage in the closed position of the gate, said cutting edge being formed on an edge portion of said port.

10. The invention set forth in claim 8, including a second undercut portion of said gate underlying said undercut open space thereof, said second undercut portion being more severely undercut than said undercut open space.

* * * * *